US007744017B2

(12) United States Patent
Cooke

(10) Patent No.: US 7,744,017 B2
(45) Date of Patent: Jun. 29, 2010

(54) INJECTION NOZZLE

(75) Inventor: Michael P. Cooke, Gillingham (GB)

(73) Assignee: Delphi Technologies Holding S.arl, Troy, MI (US)

( * ) Notice: Subject to any disclaimer, the term of this patent is extended or adjusted under 35 U.S.C. 154(b) by 332 days.

(21) Appl. No.: 11/484,466

(22) Filed: Jul. 11, 2006

(65) Prior Publication Data

US 2007/0012798 A1 Jan. 18, 2007

(30) Foreign Application Priority Data

Jul. 13, 2005 (EP) ..... 05254382

(51) Int. Cl.
*B05B 1/06* (2006.01)

(52) U.S. Cl. ..... 239/102.2; 239/533.9; 239/533.12; 239/563

(58) Field of Classification Search ..... 239/102.2, 239/533.4, 533.8, 533.9, 533.11, 533.12, 239/585.5, 900, 533.2, 533.3, 533.5, 533.6, 239/533.7, 562, 563
See application file for complete search history.

(56) References Cited

U.S. PATENT DOCUMENTS 4,407,457 A * 10/1983 Seifert ..... 239/533.12
6,513,733 B1 * 2/2003 Lambert ..... 239/533.1
7,159,799 B2 * 1/2007 Cooke ..... 239/533.12
7,309,030 B2 * 12/2007 Cooke ..... 239/533.12
7,404,526 B2 * 7/2008 Cooke et al. ..... 239/533.11
2001/0052554 A1 12/2001 Lambert et al.
2003/0052203 A1 * 3/2003 Arndt et al. ..... 239/585.5
2004/0129805 A1 * 7/2004 Boecking ..... 239/533.2

FOREIGN PATENT DOCUMENTS

| | | |
|---|---|---|
| DE | 2710138 | 9/1978 |
| EP | 0054612 | 6/1982 |
| EP | 0878623 | 11/1998 |
| EP | 1526274 | 4/2005 |

* cited by examiner

*Primary Examiner*—Christopher S Kim
(74) *Attorney, Agent, or Firm*—Thomas N. Twomey

(57) ABSTRACT

An injection nozzle for an internal combustion engine comprising a nozzle body defining a seating surface and having at least one first nozzle outlet and a valve member received within the nozzle body and engageable with an external seating defined by the seating surface so as to control fuel injection through the at least one first nozzle outlet. The valve member is provided with a bore having an internal bore surface and an insert is received within the bore. The insert includes a part-spherical head which spans an internal diameter of the bore so as to maintain contact with an internal surface of the bore as the valve member moves, in use, so as to guide movement of the valve member. The part-spherical head also includes a surface which defines an internal seating for the valve member.

5 Claims, 9 Drawing Sheets

INJECTION NOZZLE

TECHNICAL FIELD

The present invention relates to an injection nozzle for use in a fuel injector for an internal combustion engine. More particularly, although not exclusively, one aspect of the present invention relates to an injection nozzle for use in a compression ignition internal combustion engine in which at least one valve is operable to control the injection of fuel into a combustion space through one or more nozzle outlets.

BACKGROUND TO THE INVENTION

Due to increasingly stringent environmental regulations, a great deal of pressure is levied upon automotive manufacturers to reduce the level of vehicle exhaust emissions, for example, hydrocarbons, nitrogen oxides (NOx) and carbon monoxide. As is well known, an effective method of reducing exhaust emissions is to supply fuel to the combustion space at high injection pressures (around 2000 bar for example) and to adopt nozzle outlets of a small diameter in order to optimise the atomisation of fuel and so improve efficiency and reduce the levels of hydrocarbons in the exhaust gases. Although the above approach is effective at improving fuel efficiency and reducing harmful engine exhaust emissions, an associated drawback is that reducing nozzle outlet diameter conflicts against the requirement for high fuel injection flow rates at high engine loads and so can compromise vehicle performance.

So-called "variable orifice nozzles" (VONs) enable variation in the number of orifices (and therefore the total orifice area) used to inject fuel into the combustion space at different engine loads. Typically, such an injection nozzle has at least two sets of nozzle outlets with first and second valves being operable to control whether fuel injection occurs through only one of the sets of outlets or through both sets simultaneously. In a known injection nozzle of this type, as described in the Applicant's co-pending European patent application no. EP04250928, the fuel flow to a first (upper) set of nozzle outlets is controlled by an outer valve and the fuel flow to a second (lower) set of nozzle outlets is controlled by an inner valve. The inner valve is lifted by the outer valve only after the flow of fuel through the first set of nozzle outlets has reached a sufficient rate. An injection nozzle of this type enables selection of a small total nozzle outlet area in order to optimise engine emissions at relatively low engine loads. On the other hand, a large total nozzle outlet area may be selected so as to increase the total fuel flow at relatively high engine loads.

Although beneficial in many ways, such nozzles do have associated problems. For instance, if the valves do not lift with perfect concentricity, high side loads can be generated due to the hydraulic pressure being significantly lower on the side of the outer valve closest to the nozzle body. Under some conditions these side loads can be high enough to prevent the outer valve closing.

One aspect of the present invention relates to a variable orifice nozzle which aims to have the advantages of the above designs, but which serves to alleviate or overcome the aforementioned side load problem.

SUMMARY OF THE INVENTION

According to a first aspect of the present invention there is provided an injection nozzle for an internal combustion engine, the injection nozzle comprising a nozzle body defining a seating surface and having at least one first nozzle outlet, a valve member received within the nozzle body and being engageable with an external seating defined by the seating surface so as to control fuel injection through the at least one first nozzle outlet. The valve member is provided with a bore having an internal bore surface. An insert received within the bore includes a part-spherical head which spans an internal diameter of the bore so as to maintain contact with an internal surface of the bore as the valve member moves, in use, so as to guide movement of the valve member. The part-spherical head includes a surface which defines an internal seating for the valve member.

An injection nozzle having a combination of features as set out above has been found to provide particular benefits. Firstly, as the movement of the valve member is guided by the insert, it is less likely to lift in an eccentric manner, and hence the reliability of the valve is increased. It is a further benefit that the valve member is provided with both an internal seating and an external seating, one defined being by the nozzle body and one being defined by the insert in the valve bore. By providing the insert to define the internal seating, there is no restriction on the seats being at different axial heights (as in the case where two external seats are provided), so that the internal and external seats can be provided at approximately the same, or similar, axial positions. This means that the vertical area of the valve member exposed to side forces near the outlet(s) is reduced. Thirdly, the provision of the part-spherical head on the insert means that any misalignment at the internal seating for the valve member is accommodated by the head being able to move angularly about the centre of it's sphere. As the internal seating can be located close to the centre of the sphere, any torque at the internal seating resisting the realignment is minimised. Furthermore, the external seating and the internal seating can be positioned along the axis of the nozzle body in approximate alignment, at least in circumstances in which the valve member is seated.

In one preferred embodiment, the valve member terminates in a valve tip, whereby the valve member is guided at the valve tip by means of the insert. The valve tip is typically located downstream of the external seating when the valve member is seated. As the valve member can be guided conveniently at its upper end also, the valve member is therefore guided at both ends to provide improved valve control.

In a first embodiment, for example, the injection nozzle includes at least one second nozzle outlet provided in the nozzle body, wherein the insert is an inner valve which is slidable within the bore and engageable with an insert seating defined by the seating surface so as to control fuel injection through the at least one second nozzle outlet.

It is a further preferred for an annular member to be received within the bore in the valve member, wherein the annular member is engageable with the internal seating. The annular member may be a separate part from the main body of the valve member or, alternatively, the valve member may be machined so that the annular member is formed integrally therewith.

The nozzle may further comprise a sleeve member coupled to the inner valve, wherein the annular member is brought into engagement with the sleeve member when the valve member is moved axially through a distance that is greater than a predetermined distance so as to impart axial movement to the inner valve also.

Preferably, the annular member and the sleeve member have opposed end faces which are spaced apart by the predetermined distance when the valve member and the inner valve are seated against their respective seatings.

In a further preferred embodiment, the inner valve includes a valve stem and the internal seating is defined by a shoulder between the part-spherical head and the valve stem.

The end face of the annular member may be substantially flat or, alternatively, the end face of the annular member may be frusto-conical, the latter providing the advantage that there is then an annular line of contact between the annular member and the internal seating to form a fuel-tight seal.

In a second embodiment of the invention, the insert does not take the form of a valve but remains engaged with the insert seating during all stages of nozzle operation.

In this embodiment also, the valve member may include an annular member which is received within the bore of the valve member so as to be engageable with the internal seating.

As in the first embodiment, the end face of the annular member may be substantially flat or, alternatively, the end face of the annular member may be frusto-conical, the latter providing the advantage that there is then an annular line of contact between the annular member and the internal seating to form a fuel-tight seal.

As a modification to the second embodiment, the nozzle body may be provided with a vent passage through which fuel can escape in the event of fuel leakage past the external seating.

In any embodiment, the injection nozzle may further comprise an arrangement for urging the insert against the insert seating. For example, the arrangement for urging the insert against the insert seating may include at least one opening formed in the valve member which enables fuel to enter the bore, thereby to apply a hydraulic closing force to the insert. In addition, a spring may be provided to urge the insert against the insert seating.

A fuel flow path is typically provided past the external seating to the at least one first nozzle outlet, and a supplementary flow path is further provided to the at least one first nozzle outlet past the internal seating when the valve member is unseated. The supplementary fuel flow path may take the form of at least one flat or groove provided on the insert and/or at least one flat or groove provided on the valve member (the annular member or the main body of the valve member).

According to a second aspect of the invention, there is provided an injector for use in an internal combustion engine, wherein the injector includes an injection nozzle as set out in the first aspect and an actuator, preferably a piezoelectric actuator, for controlling movement of the valve member.

It will be appreciated that the preferred and/or optional features of the first aspect of the invention may be provided alone, or in appropriate combination, in the second aspect of the invention also.

BRIEF DESCRIPTION OF THE DRAWINGS

By way of example, the invention will now be described with reference to the accompanying drawings, in which.

DETAILED DESCRIPTION OF THE PREFERRED EMBODIMENTS

Figure 1:
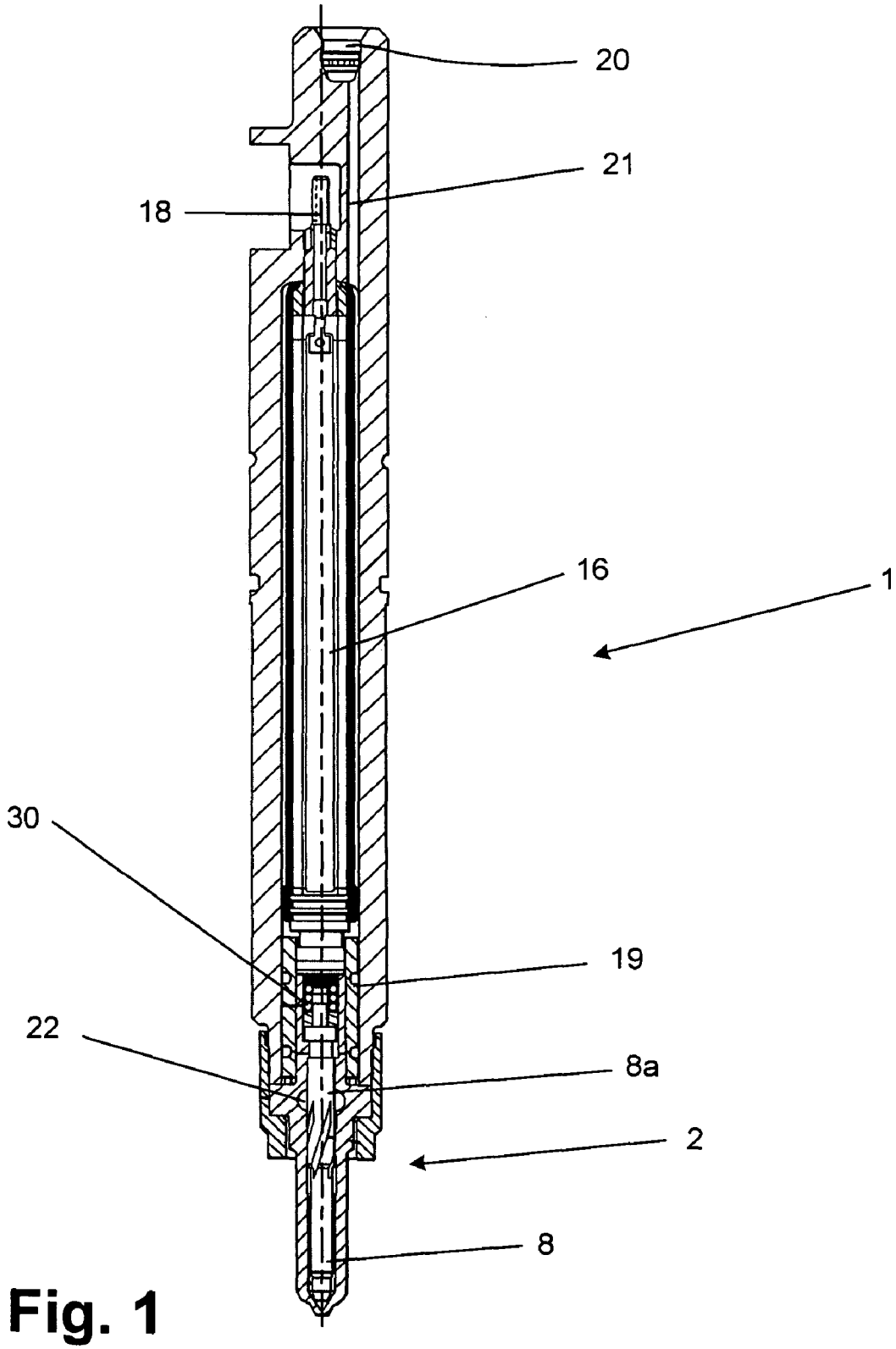
FIG. 1 is a part-sectional view of a fuel injector of the type suitable for incorporating an injection nozzle in accordance with a first embodiment of the present invention.

In the following description, the terms "upper" and "lower" are used having regard to the orientation of the injection nozzles as shown in the drawings. Likewise, the terms "upstream" and "downstream" are used with respect to the direction of fuel flow through the nozzles from a fuel inlet line to fuel outlets.

FIG. 1 shows a piezoelectric fuel injector 1 for an internal combustion engine of the type such as that described in the Applicant's U.S. Pat. No. 6,776,354. The injector 1 is suitable for incorporating an injection nozzle, referred to generally at 2, according to the present invention, which is illustrated in a first embodiment in FIG. 2.

Figure 2:
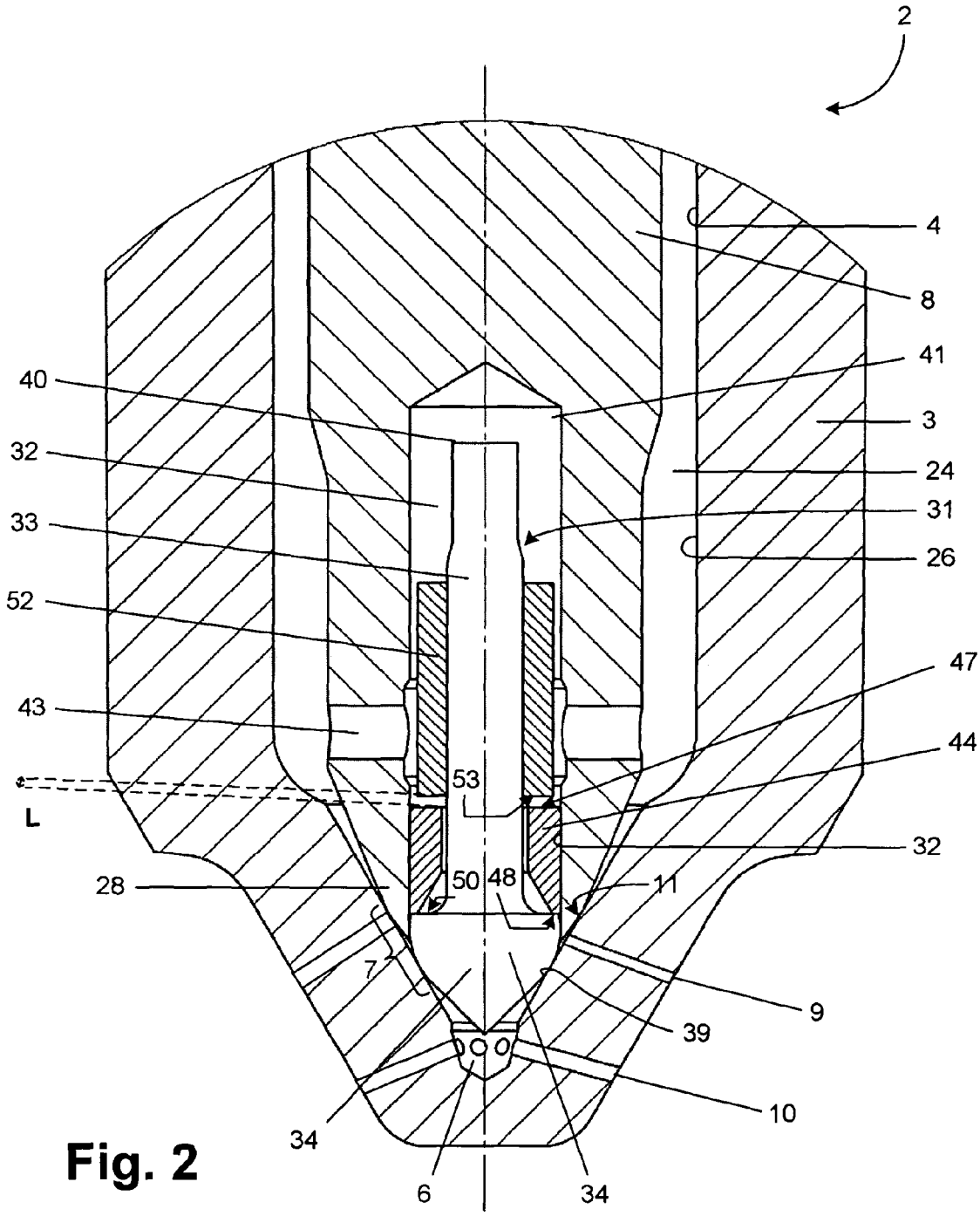
FIG. 2 is an enlarged part-sectional view of an injection nozzle according to a first embodiment of the present invention when in a non-injecting position.

Referring to FIGS. 1 and 2, the injection nozzle 2 is of the variable orifice nozzle type, including a nozzle body 3 provided with a blind axial bore 4 which terminates, at its blind end, in a sac volume 6. Towards its blind end, the bore 4 also defines a seating surface 7 of frusto-conical form. The seating surface 7 defines a first seating, in the form of an external seating 11, for a valve arrangement of the nozzle which includes an outer valve 8 slidably received in the nozzle body bore 4 so as to control injection through respective first and second sets of nozzle outlets 9, 10 (not shown in FIG. 1). Inlet ends of the first set of outlets 9 extend radially away from the seating surface 7 to open into an engine cylinder (not shown) at outlet ends of the first outlets 9. Likewise, inlet ends of the second set of outlets 10 are in communication with, and extend radially away from, the sac volume 6 to open at outlet ends of the second outlets 10.

Movement of the outer valve 8 is controlled by means of a piezoelectric actuator. The piezoelectric actuator comprises a stack 16 of piezoelectric elements, arranged within an accumulator volume 17, and an electrical connector 18 to enable a voltage to be applied across the stack 16. In use, the accumulator volume 17 forms a part of a supply passage to the injection nozzle 2 and, as it is filled with high pressure fuel, applies a hydrostatic loading to the stack 16. The piezoelectric actuator is coupled to the outer valve 8 via a hydraulic amplifier arrangement 19 and movement of the outer valve 8 is controlled by varying the voltage applied to the stack 16 in order to cause the stack 16 to extend and contract.

When the voltage across the stack 16 is reduced, the stack length contracts and the outer valve 8 is drawn upwards, away from the external seating 11. When the voltage is increased, the stack length increases and the outer valve 8 is moved downwards, towards the external seating 11.

Fuel is supplied to the injector 1 via an inlet 20 from, for example, a common rail or other appropriate source of pressurised fuel, which is also arranged to supply fuel to one or more other injectors of the engine. Pressurised fuel is communicated from the inlet 20, through an inlet passage 21 and the accumulator volume 17, to an annular chamber 22 defined within the bore 4 between the nozzle body 3 and an upper region 8*a* of the outer valve 8. The upper end region 8*a* has a diameter substantially equal to that of the nozzle body bore 4 such that, in use, co-operation between these parts serves to assist in guiding movement of the outer valve 8 as it reciprocates within the bore 4. Spiral flutes machined into the upper region 8*a* provide a flow path for fuel to be communicated from the annular chamber 22, through the bore 4 and into a nozzle delivery chamber 24.

As can be seen in FIG. 2, the first and second sets of outlets 9,10 are shown as having two or more outlets in each set, each set being disposed at a different axial position along the nozzle body 3. Alternatively, each set of outlets 9,10 may include only a single outlet. For the purposes of this specification, therefore, any reference to 'outlet' shall be considered as applying to one or more outlets, and vice-versa.

The outer valve 8 terminates at its lower end in a tip 28 which is engageable with the external seating 11 so as to control whether fuel within the delivery chamber 24 is able to flow out through the first outlets 9. The outer valve 8 is biased towards the external seating 11 by means of a resilient element in the form of a closing spring 30 (shown in FIG. 1 only), and is operable to move away from the external seating 11, against the force provided by the closing spring 30, by means of the actuator.

The injection nozzle 2 also includes an insert 31 in the form of an inner valve member which is slidably received within a blind axial bore 32 provided in the lower region of the outer valve 8. The inner valve 31 is shaped to include an upper stem region 33 of generally uniform cross-section and an enlarged, part-spherical head 34 having a greater diameter than that of the stem 33 and terminating in a generally conical tip. At its widest point, where the head 34 meets the stem 33, the head 34 has an outer diameter substantially equal to that of the internal diameter of the outer valve bore 32 so that it spans this internal diameter and makes contact with an internal surface of the valve bore 32 around its periphery. A flat, upper surface of the inner valve head 34 defines a shoulder on the inner valve 31 which provides an internal seating 50 for the outer valve 8, so that the outer valve has two seats (i.e. the external seating 11 and the internal seating 50). In the closed position illustrated in FIG. 2, the inner valve 31 is seated on an insert seating, referred to as the inner valve seating 39, which is defined by a region of the seating surface 7 at a position below the first outlets 9.

The upper end 40 of the inner valve 31 is accommodated in a chamber 41 defined by the blind end of the outer valve bore 32. The chamber 41 is in communication with the nozzle body bore 4 via radial passages 43, in the form of cross drillings, provided in the outer valve 8 so that pressurised fuel within the bore 4 is able to flow into the outer valve bore 32 and the chamber 41. Fuel pressure within the chamber 41 acts on the inner valve 31 and so provides an arrangement for biasing the inner valve 31 against the inner valve seating 39.

Movement of the inner valve 31 towards and away from the inner valve seating 39 controls fuel injection through the second set of outlets 10. Unlike the outer valve 8, however, the inner valve 31 is not actuated directly by the piezoelectric stack 16. Instead, and as will be described in greater detail hereinafter, once the outer valve 8 has moved upwards (i.e. away from the external seating 11) beyond a pre-determined distance, it conveys movement to the inner valve 31 causing it to move upwards away from the inner valve seating 39.

The outer valve 8 further comprises an annular member or ring 44 which is received within the outer valve bore 8. The ring 44 is a separate and distinct part and is coupled to the outer valve 8 through frictional contact between the outer surface of the ring 44 and the internal surface of the outer valve bore 32. That is to say, the ring 44 is an interference fit with the outer valve bore 32. Together, the outer valve 8 and the ring 44 form a moveable valve arrangement. In an alternative embodiment, the inner valve 31 may be constructed differently so that the ring 44 forms an integral part of the outer valve 8. The ring 44 includes a first, upper end face 47 and a second, lower end face 48. In the closed position, the lower end face 48 of the ring 44 engages with the internal seating surface 50 defined by the upper face of the inner valve head 34.

The internal diameter of the ring 44 is greater than the outer diameter of the inner valve stem 33, such that the stem 33 passes through the ring 44 and defines a clearance fit therewith. In the position shown in FIG. 2, the inner valve 31 is held against its seating 39 by virtue of the ring 44 acting in combination with high pressure fuel within the chamber 41.

The inner valve 31 carries a substantially tubular member in the form of a sleeve 52, which is a separate and distinct part from the inner valve 31, so that the upper end face 47 of the ring 44 opposes a first, lower end face 53 of that sleeve 52. The sleeve 52 has an external diameter which is less than the internal diameter of the outer valve bore 32 so that the inner valve 31 is free to slide within the bore 32. The sleeve 52 has an internal diameter which is substantially equal to the outer diameter of the inner valve stem 33 so that the sleeve 52 forms an interference fit with the stem 33, and so is coupled to the stem 33 through frictional contact.

The lower end face 53 of the sleeve 52 and the upper end face 47 of the ring 44 are separated by a distance 'L' that is predetermined at manufacture. The distance 'L' determines the amount by which it is necessary for the outer valve 8 to lift away from its internal and external seatings 50, 11 before engaging the sleeve 52 to convey movement to the inner valve 31. It should be appreciated that the lower end face 53 of the sleeve 52 and the upper end face 47 of the ring 44 are at maximum separation (i.e. predetermined distance 'L') when both the inner valve 31 and the outer valve 8 are seated, as shown in FIG. 2.

In use, fuel under high pressure is delivered from the common rail to the nozzle body bore 4 (and thus the delivery chamber 24) via the inlet 20, the inlet passage 21 and the stack volume 17. Initially, the piezoelectric actuator is energised to a relatively high energisation level so that the stack 16 is in an extended state. In such circumstances, the outer valve 8 is held against its internal and external seatings 50, 11 due to the biasing force of the closing spring 30. The inner valve 31 is held against its seating 39 due to the pressure of the fuel within the chamber 41 and also by the ring 44 abutting the internal seating surface 50.

Figure 3:
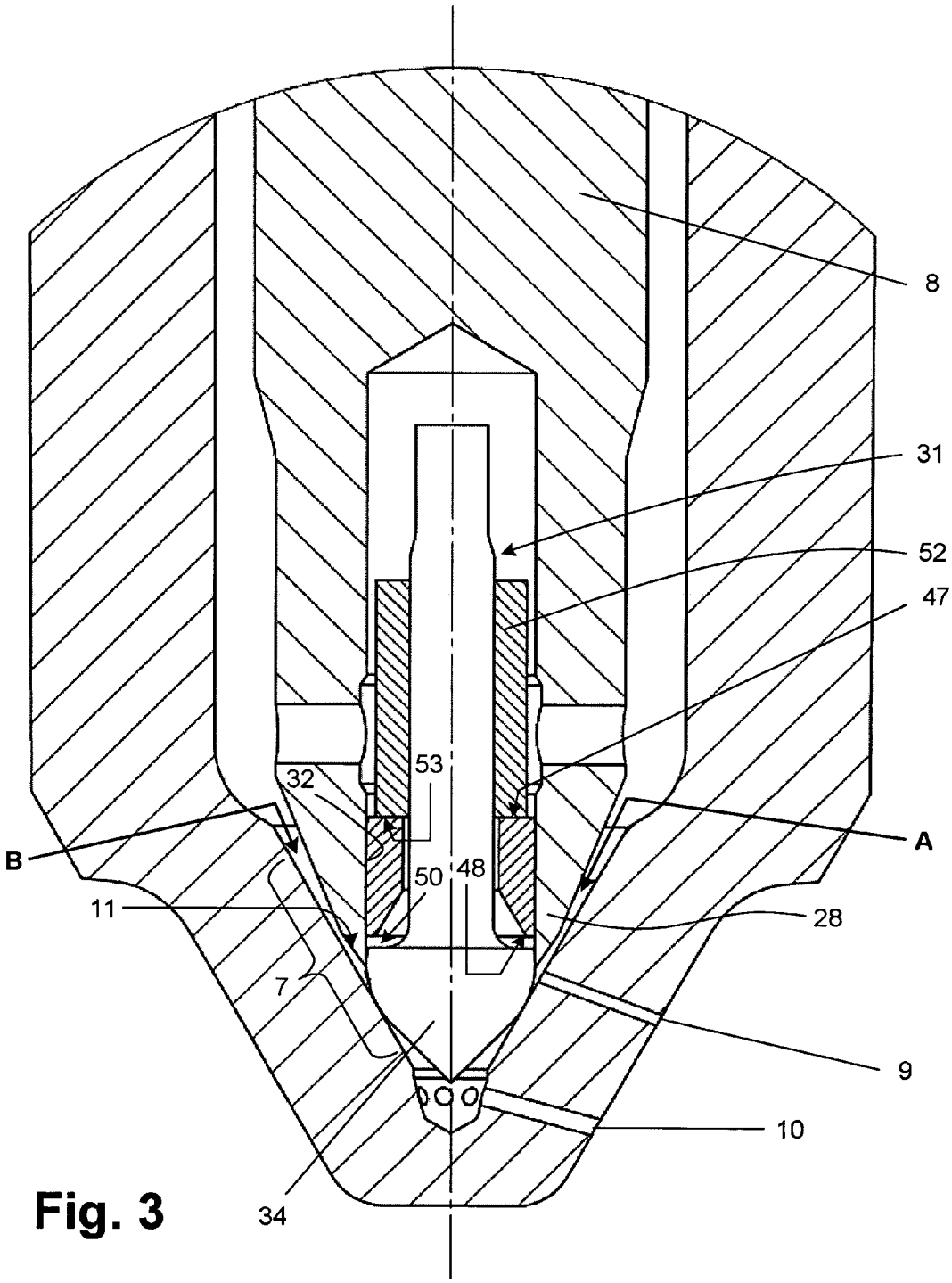
FIG. 3 is a part-sectional view of the injection nozzle of FIG. 2 when in a first injecting position.

Referring to FIG. 3, in order to inject fuel through the upper set of outlets 9 only, the stack 16 (not shown in FIG. 3) is de-energised to a first, intermediate energisation level causing it to contract, resulting in a lifting force being transmitted to the outer valve 8. The outer valve 8 is thus urged to move away from its internal and external seatings 50, 11 to open a flow path A, B for fuel past the external seating 11 and, thus, through the first set of outlets 9. It will be appreciated that the flow path to the outlets 9, 10 which is opened as the outer valve 8 lifts from the external seating 11 is an annular flow path around the outer valve 8, although in the section shown it is identified as two flow paths A, B.

Although the ring 44 is caused to separate from the internal seating 50 when the outer valve 8 lifts away from the external seating 11, there is substantially no fuel flowing to the first set of outlets 9 past the seating 50 as the outer surface of the inner valve head 34 in the region of the outer valve tip 28 remains engaged with the internal surface of the bore 32. In practice, a very small amount of leakage fuel may be able to flow between the outer surface of the inner valve head 34 and the internal surface of the bore 32 when the outer valve 8 is lifted, but when the valve 8 is seated on the internal surface 50 any such leakage is prevented. The provision of the internal seating 50 is therefore advantageous as any unwanted leakage through this route between injections would have a detrimental effect on engine emissions.

During this initial de-energisation of the stack 16, the outer valve 8 is caused to move through a distance less than or equal to the distance 'L' (identified on FIG. 2). The ring 44 is carried with the outer valve 8 so that the upper end face 47 of the ring 44 approaches the opposing lower end face 53 of the sleeve 52. In FIG. 3, the ring 44 is moved exactly through the distance L so that it just makes contact with the sleeve 52. Provided the distance through which the outer valve 8 moves is no greater than the pre-determined distance 'L', movement of the outer valve 8 remains decoupled from the inner valve 31, which remains firmly seated against the inner valve seating 39 under the influence of pressurised fuel within the chamber 41. Fuel is therefore unable to flow past the seated inner valve 31 to the second outlets 10.

One beneficial feature of nozzle operation is that, during this initial lift stage, the contact between the peripheral surface of the inner valve head 34 and the internal surface of the outer valve bore 32 provides effective guidance for the outer valve tip 28 as the valve 8 is retracted. The outer valve 8 is thus guided at both its upper and lower ends, 8*a* and 28 respectively.

The above described condition represents fuel injection optimised for relatively low power applications since a relatively small volume of fuel is injected through the first set of relatively small outlets 9 only.

If, at this point, it is necessary to terminate injection through the first outlets 9, the stack 16 is re-energised to its initial energisation level causing the stack 16 to extend. As a result, the outer valve 8 is caused to re-engage both with the external seating 11, defined by the surface 7, and the internal seating 50, defined by the inner valve 31, under the influence of the biasing force of the closing spring 30 (shown in FIG. 1).

Figure 4:
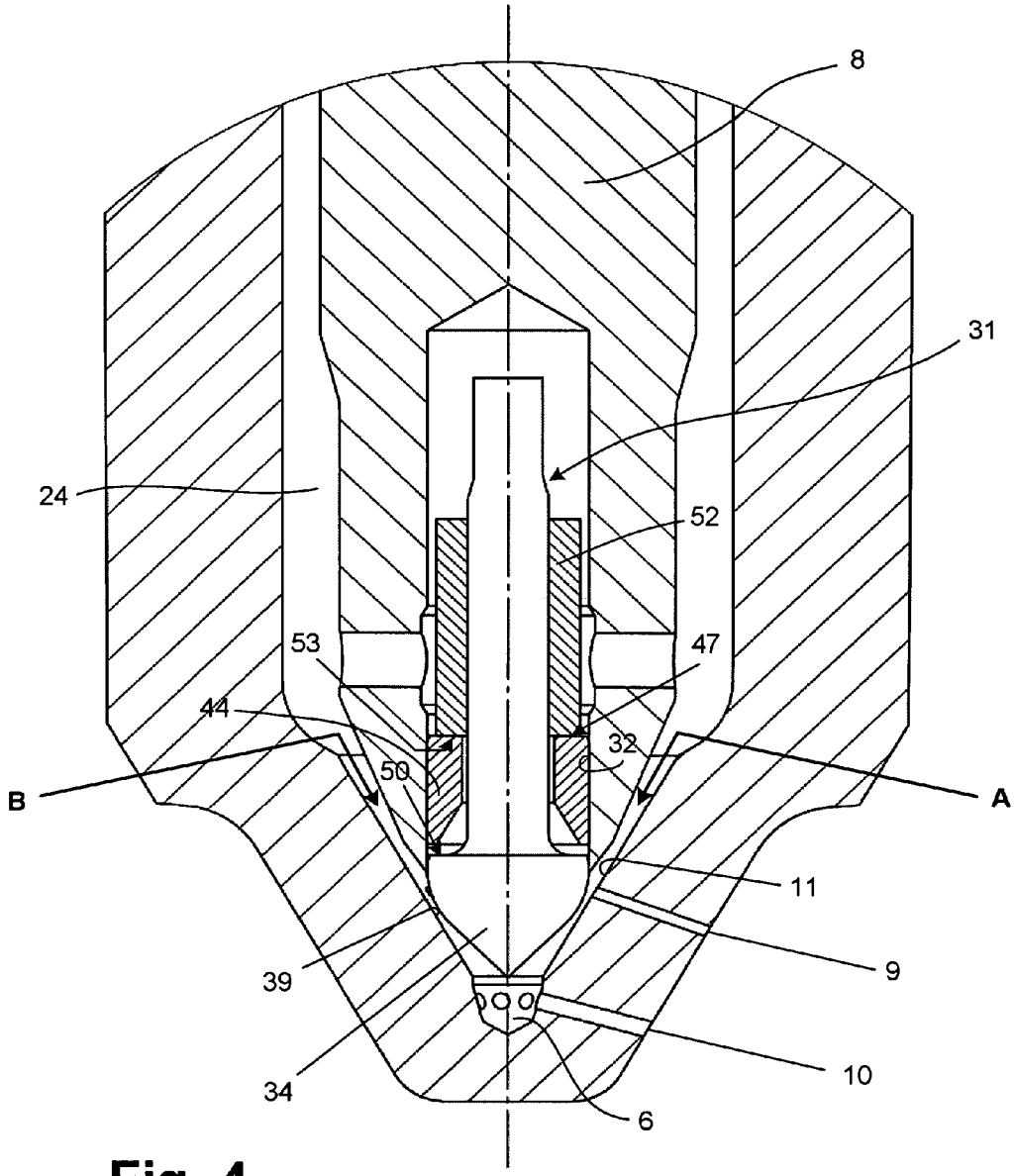
FIG. 4 is a part-sectional view of the injection nozzle of FIG. 2 when in a second injecting position.

FIG. 4 shows the injection nozzle 2 during a subsequent, or alternative, stage of injector operation in which the stack 16 may be de-energised further to a second energisation level causing the stack length to be reduced further. As a result, the outer valve 8 is urged away from its internal and external seatings 50, 11 by a further mount, which is greater than the predetermined distance 'L'. In such circumstances, the upper end face 47 of the ring 44 is caused to engage the lower end face 53 of the sleeve 52, thereby causing the movement of the outer valve 8 to be conveyed or coupled to the inner valve 31. As a result, the inner valve 31 is caused to lift from the inner valve seating 39.

As the inner valve 31 lifts away from its seating 39, fuel within the delivery chamber 24 is not only able to flow past the external seating 11 to the first set of outlets 9 (by virtue of the outer valve 8 being open), but also past the inner valve seating 39 to the second (i.e. lower) outlets 10 and into the combustion chamber via the sac volume 6. The flow through the second outlets 10 supplements the fuel flow through the first outlets 9 to provide a higher fuel injection rate suitable for higher engine power modes.

Termination of injection occurs if the stack 16 is energised once again to the higher energisation level, as described previously. Alternatively, the energised level may be increased slightly to the first level so that only the outer valve 8 is lifted and the inner valve 31 returns to its seating 39 so as to close the flow path to the second outlets 10.

It is a particular benefit of the nozzle described previously that the contact between the outer surface of the inner valve head 34 and the inner surface of the outer valve bore 32 provides robust guidance of the outer valve tip 28 when the outer valve 8 is retracted. This ensures that the concentricity of the outer valve tip 28 is improved when the outer valve 8 is lifted. In consequence, there is an increase in the resilience of the outer valve 8 to the generation of the high lateral forces that result from differences in fuel flow past either side of the outer valve (i.e. differences in flow through paths A and B). Such forces may arise in the event of any eccentricity between the outer valve 8 and the bore 4 as the outer valve 8 lifts. A more effective and reliable seal can therefore be established between the outer valve 8 and the external seating 11, thus providing a more reliable valve closure.

It is a further benefit of the invention that as the pressure within the outer valve bore 32 is high, the pressure drop below that region of the outer valve 8 which seats against the external seating 11 only applies to the relatively small area between this region and the outer valve bore 32. The force needed to lift the valve 8 equals the pressure drop times the vertically projected area downstream of the seats 11, 50. In this case, the initial area is given by:

$$\text{Area} = \frac{\pi}{4}((\text{external seat diameter})^2 - (\text{internal seat diameter})^2).$$

Hence, the force required to lift the outer valve 8 is low. The low lift force requirement makes the nozzle particularly suitable for operation by a direct acting actuator as described here (rather than via a hydraulic servo arrangement) as the relatively low energy requirement can be provided by the piezoelectric stack. Moreover, because the vertically projected area downstream of the seats is low, any side to side imbalance in the pressure can only create a small side force, minimising the likelihood of friction preventing the valve closure.

A further benefit is achieved as the outer valve 8 seats against a component (the inner valve 31) which has a part-spherical surface in engagement with the inner valve seating 39. The part spherical nature of the inner valve 31 allows it to rotate, or tilt, about the centre of its sphere to correct any misalignment of the internal seating 50 on its upper face. As the centre of the spherical head 34 is spaced only a short distance from the internal seating 50 (the internal surface 50 itself being a 'flat top' of the part-spherical head 34), any torque on the inner valve 31 arising from friction at the seating 50, which would otherwise resist the realignment, is minimal. As the internal seating 50 is defined by the upper surface of the part-spherical head 34, this also means that the external seating 11 and the internal seating 50 can be approximately aligned along the axis of the nozzle when the outer valve 8 is seated, and only axially spaced by a relatively small amount (at most, by the predetermined lift distance L), when the outer valve 8 is lifted.

Figure 5:
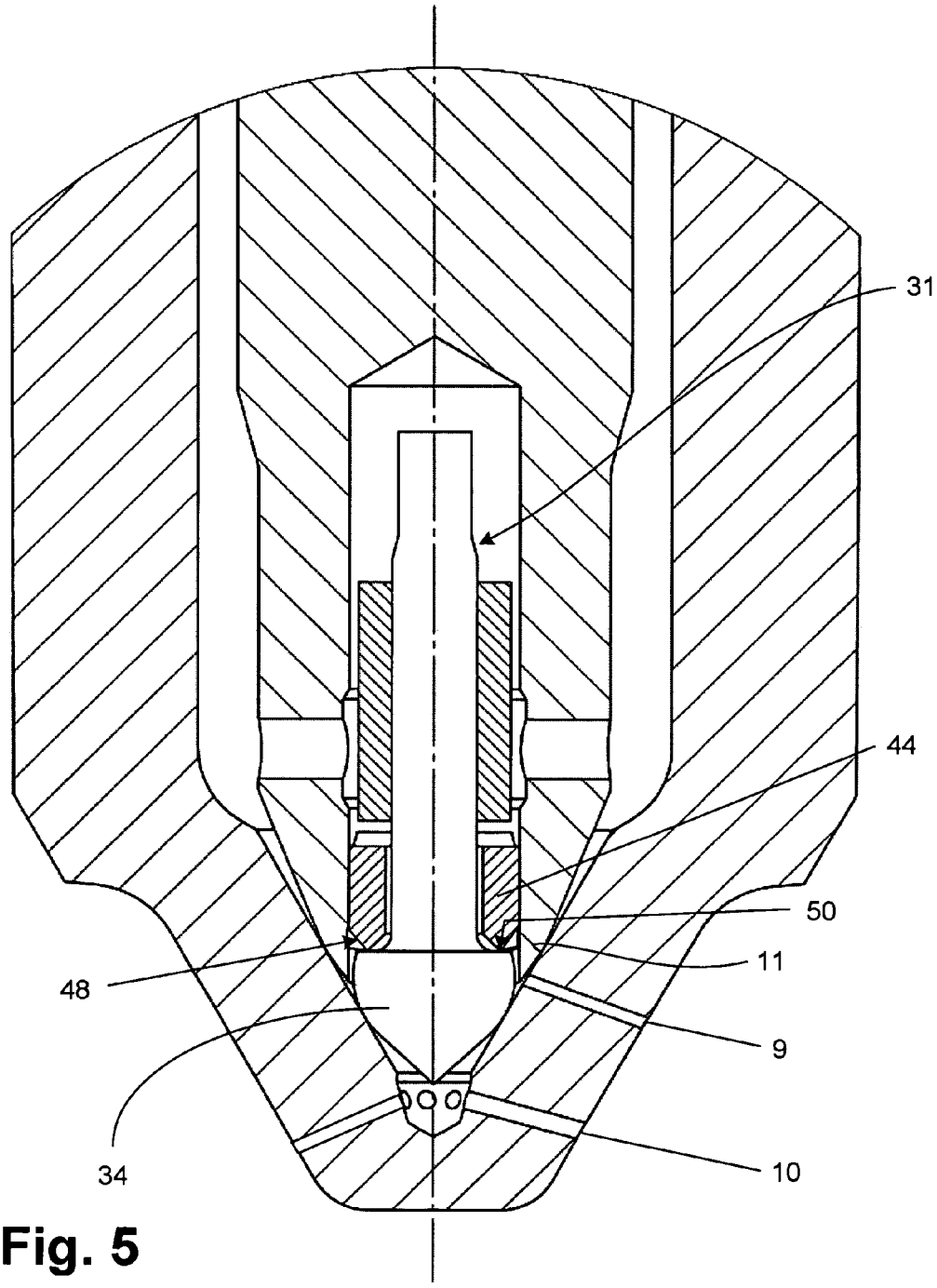
FIG. 5 is an enlarged part-sectional view of an injection nozzle according to a second embodiment of the present invention when in a non-injecting position.

FIG. 5 shows a second embodiment of the invention, whereby instead of the lower face 48 of the ring 44 being flat, it is inclined at an angle to the horizontal (i.e. the lower face is frusto-conical) in order to generate a distinct annular seating line against the internal seating 50. Concentrating the seating to a distinct annular line, rather than a face to face contact, is likely to give an improved seal which is more tolerant of flatness errors and less likely to trap dirt.

As an alternative to this embodiment (not shown), a ring 44 with a flat lower face 48 may be arranged to co-operate with an inclined surface at the head 34 of the inner valve 31.

Figure 6:
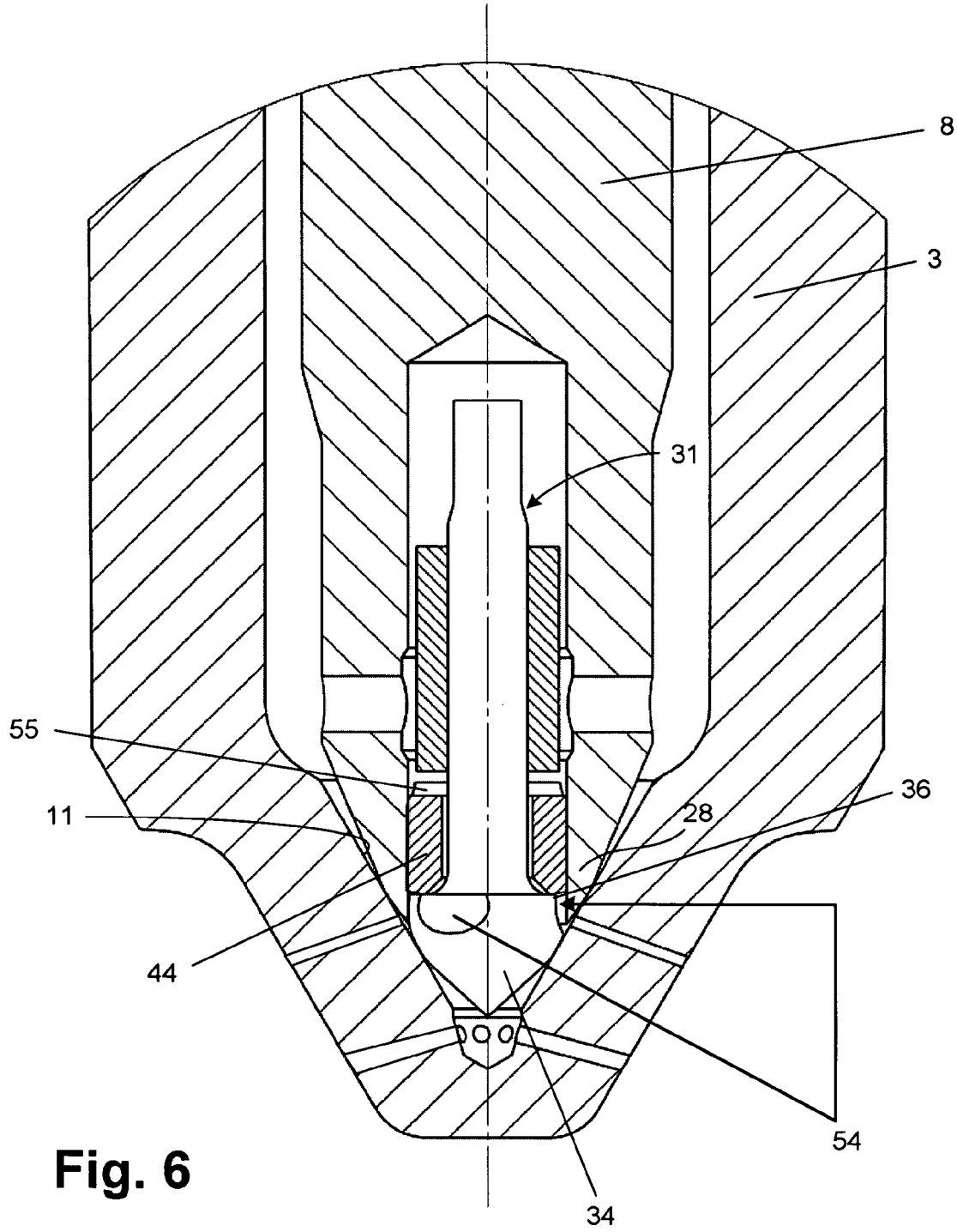
FIG. 6 is an enlarged part-sectional view of an injection nozzle according to a third embodiment of the present invention when in a non-injecting position.
Figure 7:
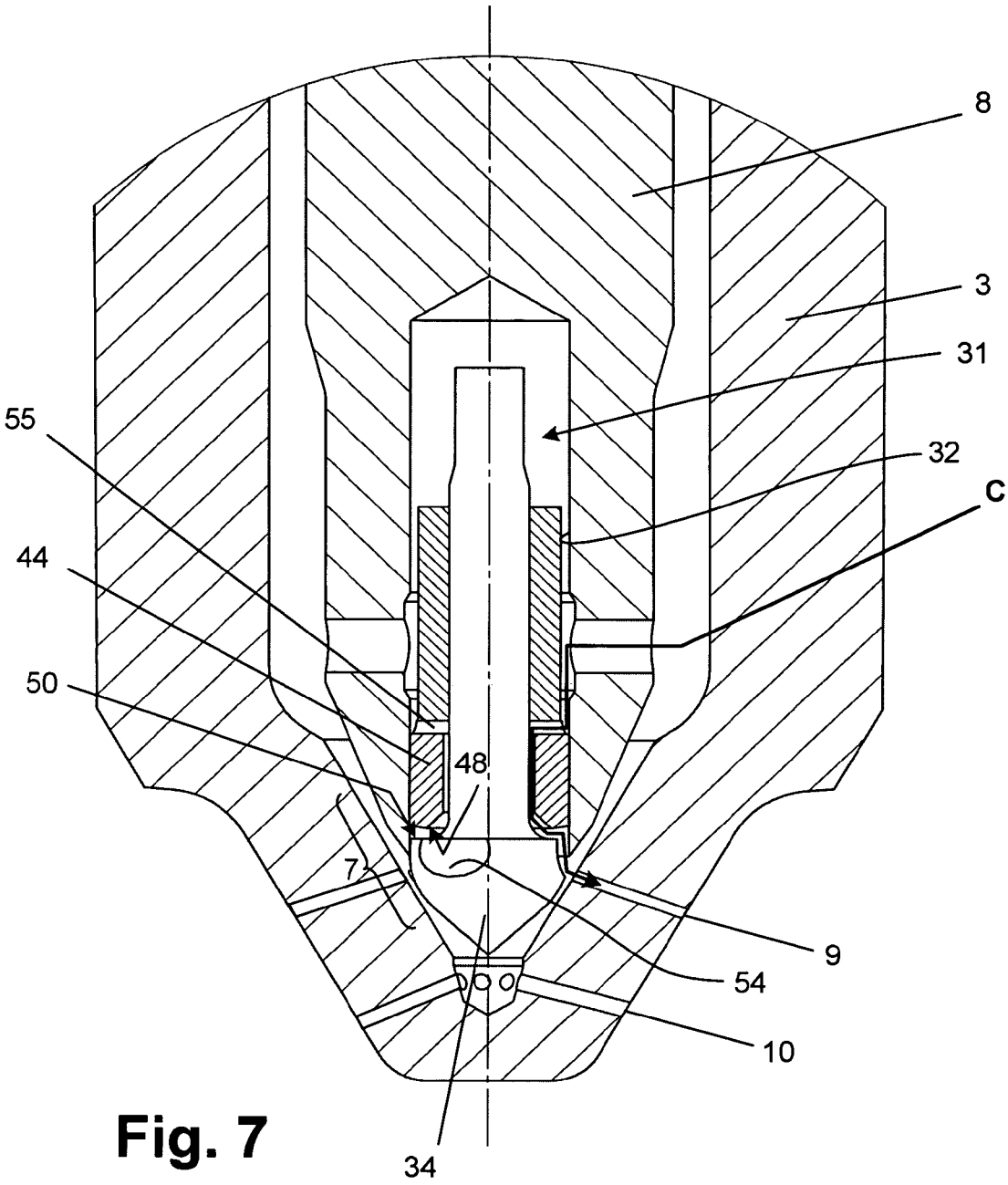
FIG. 7 is a part-sectional view of the injection nozzle of FIG. 6 when in a first injecting position.

FIG. 6 shows a third embodiment which differs from the embodiment shown in FIG. 2 in that the inner valve head 34 is provided with flats 54 (or slot, groove or hole) on its outer surface. Furthermore, a flow passage in the form of a flat 55 (or slot, groove or hole) is provided on the ring 44 of the outer valve 8. As will be appreciated from FIG. 7, which illustrates the embodiment of FIG. 6 in a first injecting position in which only the outer valve 8 is lifted, the flats 54, 55 mean that the inner valve 31 can simultaneously provide guidance of the outer valve tip 28 and also a supplementary flow-path, identified as C, for fuel flow to the first set of outlets 9. More specifically, the flats 54, 55 permit a substantial flow of fuel past the internal seating surface 50 of the inner valve 31 when the outer valve 8 is lifted. The flats 54, 55 also permit a substantial flow past the internal seating 50 to the first and second sets of outlets 9, 10 when both outer and inner valves 8, 31 are lifted.

At higher lifts (not shown in FIG. 6), as the outer valve 8 is lifted further away from its internal and external seatings, 50, 11, respectively, the effective point of the internal seat restriction will move towards the bore diameter as the clearance between the part-spherical head 34 and the outer valve bore 32 becomes more restrictive than that at the internal seating 50. That is to say, as the outer valve 8 is lifted higher the fuel flow is most restricted through the channel formed between the peripheral surface of the part-spherical head 34 and the inner surface of the outer valve bore 32, as this channel becomes increasingly smaller relative to the spacing between the lower end face 48 of the ring 44 and the internal seating 50.

It will be appreciated that operation of the second and third embodiments may be carried out in a similar manner to that of the first embodiment in FIGS. 2 to 5.

Figure 8:
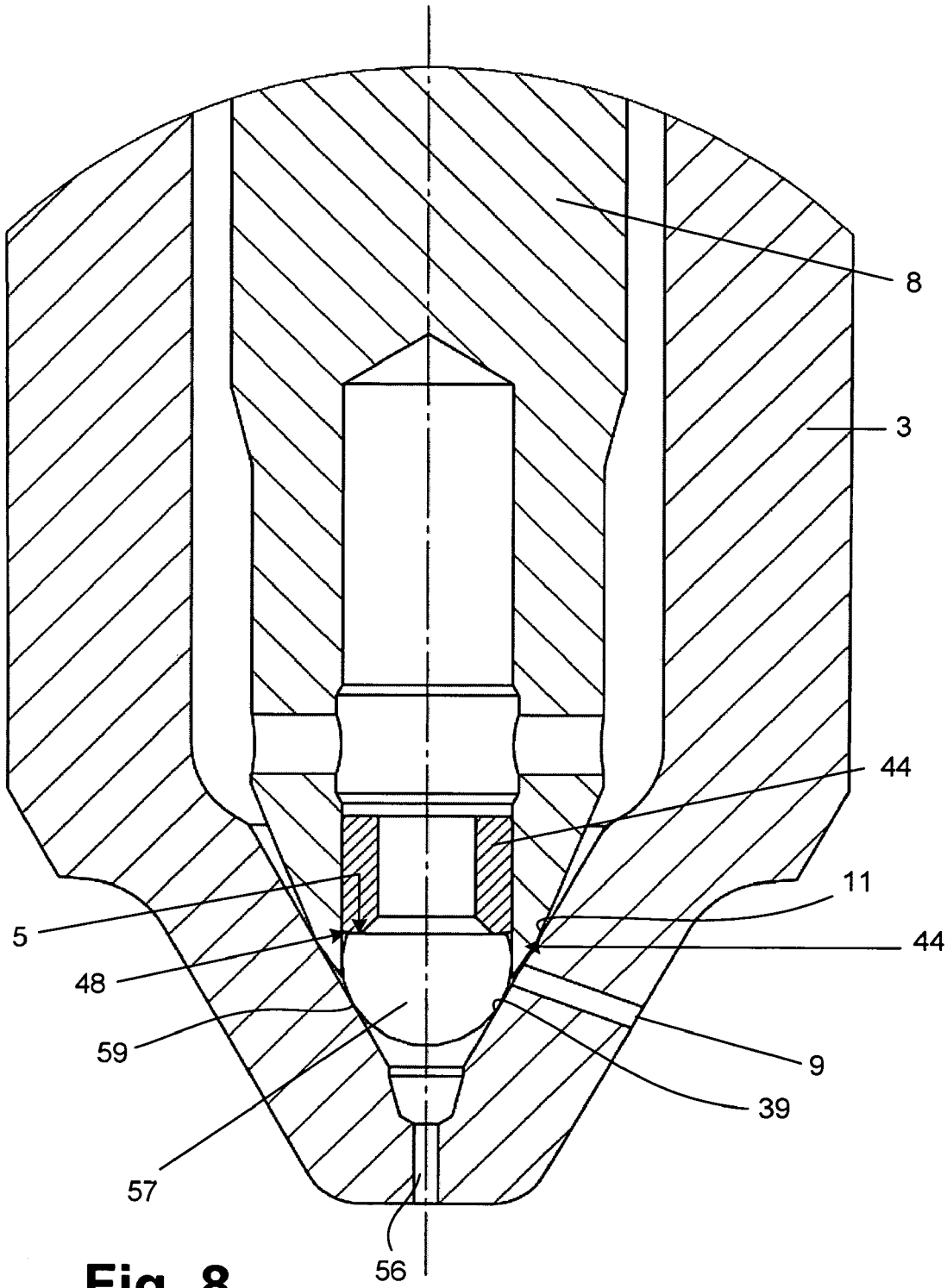
FIG. 8 is an enlarged part-sectional view of a fourth embodiment of the present invention when in a non-injecting position.
Figure 9:
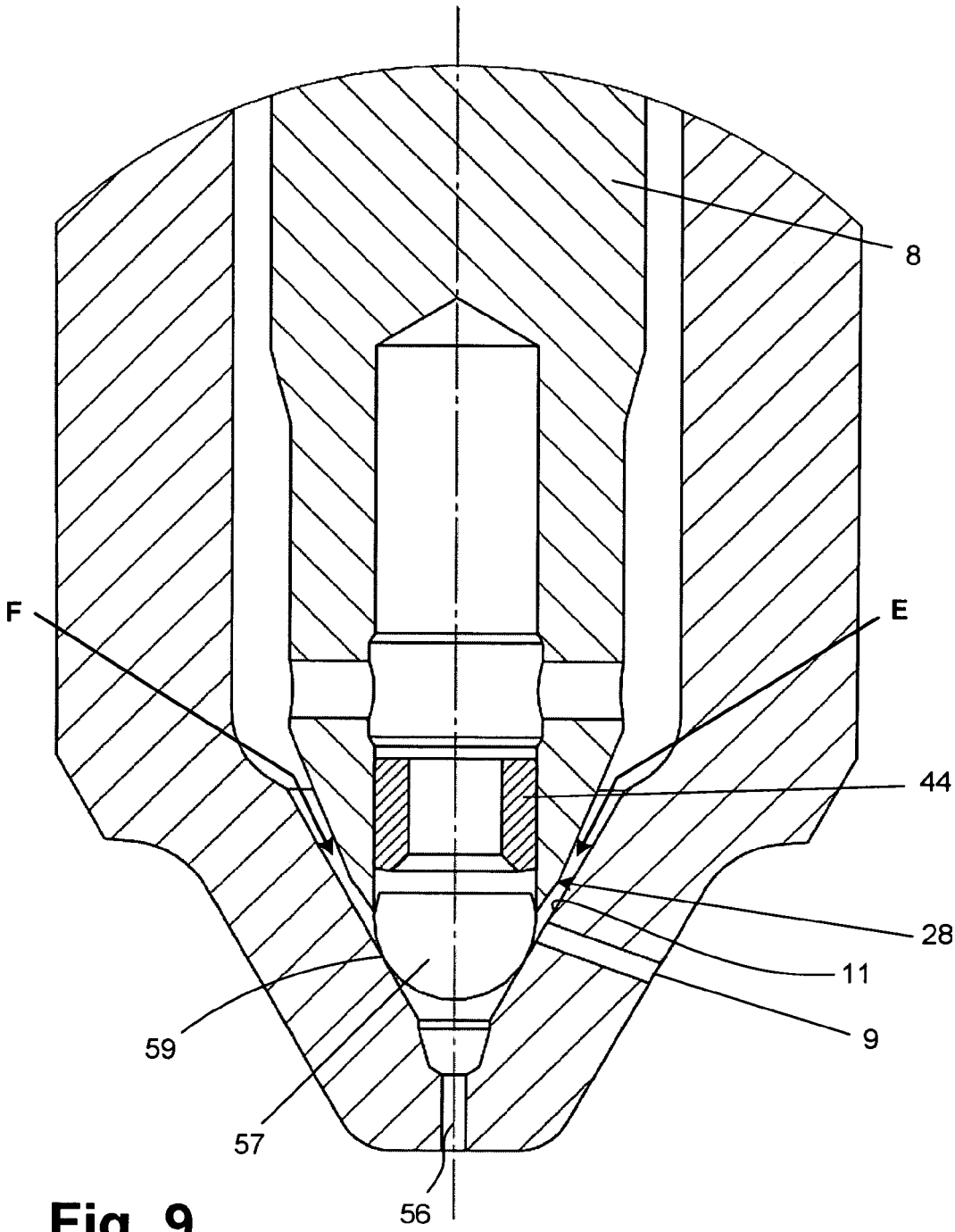
FIG. 9 is a part-sectional view of the injection nozzle of FIG. 9 when in an injecting position.

FIGS. 8 and 9 illustrate a fourth embodiment of the present invention. This embodiment is broadly similar to the embodiment in FIGS. 2 to 4, so like parts will be numbered accordingly and not described again here.

The fourth embodiment differs from the first embodiment in that the nozzle body 3 is provided with only a single set of outlets 9 to the engine cylinder, but is however provided with an additional outlet 56, the function of which will be described hereinafter. Another modification is that the inner valve is replaced with a substantially immovable part-spherical insert 57 having a part-spherical external surface 59 and a flat, upper surface 50. The part-spherical surface 59 seats on the seating 39 defined by the nozzle body 3 and is received within the lowermost end of the outer valve bore 32 so as to make contact with the internal surface of the bore 32.

The fourth embodiment includes a ring 44 having a frusto-conical lower face 48 similar to that shown in FIG. 5, although a ring having a flat lower face could equally be used. When the nozzle 2 is in the non-injecting position, the ring 44 seats against the internal seating 50 provided on the insert 57.

In the event that the ring 44 is slightly misaligned in the outer valve bore 32, the insert 57 can adjust its seating angle on the surface 39 by rotating, or tilting, about the centre of its sphere, so that its flat upper face 50 can adopt the angle of the ring 44 and, hence, account for the misalignment. The nozzle outlets 9 are therefore sealed effectively from high pressure fuel at both the external and internal seatings 11, 50 of the outer valve 8.

High pressure fuel enters the outer valve bore 32 and, together with the force of the spring (not shown in FIG. 8), which is transmitted to the part-spherical insert 57 via the ring 44, serves to hold the insert 57 against its seating 39. The additional outlet 56 in the nozzle body 3 provides a vent underneath the insert 57 to ensure that any fuel leaking around the insert 57 into the tip of the nozzle body 3 simply vents into the engine cylinder. In this way, the insert 57 is prevented from lifting from its seating 39 because of fuel trapped beneath it.

Referring to FIG. 9, when it is desired to inject fuel through the outlets 9, the outer valve 8 is retracted by means of the piezoelectric stack 16 (not identified in FIG. 9) causing the ring 44 to disengage from the internal seating 50. In such circumstances, an annular flow path E, F opens up past the external seating 11 so that high pressure fuel can flow out through the outlets 9 into the engine cylinder.

As the part-spherical insert 57 is effectively rooted to its seating 39 by virtue of the high pressure fuel in the outer valve bore 32, it is able to provide guidance to the tip 28 of the valve 8 as it is retracted by virtue of the contact between the external surface 59 of the insert 57 and the internal surface of the outer valve bore 32. Furthermore, as the insert 57 remains received within the outer valve bore 32 at all times, fuel is unable to flow past the internal seating 50 to the outlets 9. The inner valve 31 continues to provide guidance for the outer valve 8 at its tip 28 even when the inner valve 31 is lifted by virtue of the flow around the outer surface of the inner valve 31 which generates a hydraulic centralising force relative to the nozzle body 3. In this embodiment, the external seating 11 and the internal seating 50 are approximately aligned along the axis of the nozzle when the outer valve 8 is seated and when the outer valve 8 is lifted, as the insert 57 is not caused to move axially under any circumstances.

A variation on this fourth embodiment (not shown) is to provide one or more flats on the external surface 59 of the insert 57 in the same way as described previously. Such a variation ensures effective guidance of the tip 28 of the outer valve 8 is maintained as it is lifted, as in FIGS. 8 and 9, but also provides a supplementary flow path to the outlet 9 through the outer valve bore 32 when the valve 8 is lifted.

Again, as the outer valve bore 32 has full fuel pressure within it, the pressure drop below that region which engages with the external seating 11 only applies to the relatively small area between this region and the outer valve bore 32, meaning that the force required to lift the outer valve 8 is low.

A method by which the inner 31 and outer valves 8 according to the first embodiment may be assembled within the nozzle body 3 will now be described, with general reference to the aforementioned FIGS. 1 to 7 and the reference numerals indicated therein.

Initially, the ring 44 is caused to receive the stem region 33 of the inner valve 31 so that the lower face 48 of the ring 44 abuts the internal seating 50 defined on the inner valve head 34. With the ring 44 in position, the stem region 33 is received in the sleeve 52 such that the ring 44 is retained on the inner valve 31. In order to set the predetermined distance 'L', a spacer tool, such as a shim of thickness 'L' (not shown), is positioned against the upper end face 47 of the ring 44, whereby the sleeve 52 is pushed so as to engage the shim. When the shim is removed, the necessary separation of distance 'L' is established between the upper end face 47 of the ring 44 and the lower end face 53 of the sleeve 52.

Following assembly of the inner valve 31, the ring 44 and the sleeve 52, the combined inner valve 31 and ring/sleeve assembly 44, 52 is pushed into the bore 32 of the outer valve 8. The inner and outer valves 31, 8 are then together inserted into the nozzle body bore 4 such that the outer valve 8 engages with its internal and external seatings 50, 11 and the inner valve 31 engages its seating surface 39. Following assembly of the nozzle 2 a bedding operation is performed in order to establish effective seals at the seatings 39, 11 of the inner and outer valves 31, 8, respectively. The seat bedding operation comprises applying a constant predetermined axial force to the outer valve 8, causing it to "bed in" over the external seating 11. As an alternative to applying a predetermined constant axial force to the outer valve 8, the bedding in operation could also be dynamic.

Regarding the manufacture of the embodiment in FIGS. 8 and 9, to ensure that the outer valve 8 contacts with both internal and external seatings 50, 11 simultaneously to provide an effective seal for the outlets 9, the ring 44 is pushed into its final position by assembling all the components within the nozzle body 3 and applying a load to the valve 8 until a seal is formed at the external seating 11 (or makes contact with a given force).

It will be understood by those who practice the invention and those skilled in the art, that various modifications and improvements may be made to the invention without departing from the scope of the invention, as defined by the claims. For example, although in the first, second and third embodiments the inner valve 31 is forced into engagement with its seating 39 by the high pressure fuel in the outer valve bore 32 and the ring 44 in abutment with the inner valve head 34, it is possible that, in use, the lower end face 48 of the ring 44 may wear such that a clearance develops at the seating 50 even when the inner and outer valves 31, 8 are seated, so compromising the seal established by the inner valve 31 on the nozzle body 3. To address this, it may be desirable to provide a resilient member such as a helical spring (not shown) within the chamber 41 to provide a further biasing force to the inner valve 31. Such a spring may abut against an upper end face of the sleeve 52 such that the biasing force is transmitted to the inner valve 31 via the frictional coupling between these parts. Alternatively the spring may abut a separate abutment member located within the chamber 41.

Furthermore, although the ring 44 and the sleeve 52 are coupled to the outer valve 8 and inner valve 31, respectively, through frictional contact, it will be appreciated that coupling may be achieved through an alternative arrangement, for example by gluing or soldering.

It should be understood that although the injection nozzle 2 of the present invention has been described as suitable for use within an injector 1 having a piezoelectric actuator, it is entirely possible that the injector 1 may include an alternative form of actuator for moving the valve(s). For example, instead of a piezoelectric actuator, the outer valve may be moved by means of an electromagnetic actuator.

Although the nozzle body 3 has been described as defining the external seating 11 and the insert seating 39 for the outer valve 8 and the insert 31, 57 respectively, the nozzle body 3 may be provided with a lining plate, sleeve or similar so as to define these surfaces. Similarly, the ring 44 could be provided with a covering plate over its lower end face 48 to define that surface of the outer valve 8 that engages with the internal seating 50. Also, either the inner valve 31 or the insert 57 could be provided with covering plates or similar so as to define the internal seating 50. In another modification, the outer valve bore 32 may be provided with a lining sleeve, or similar component, so as to define the internal bore surface.

The invention claimed is:

1. An injection nozzle for an internal combustion engine, the injection nozzle comprising:

a nozzle body disposed about a longitudinal axis, said nozzle body defining a seating surface and having at least one first nozzle outlet;

a valve member received within the nozzle body and being engageable with an external seating defined by the seating surface so as to control fuel injection through the at least one first nozzle outlet, the valve member being provided with a blind axial bore and defining a passage extending radially from the outer surface of the valve member to the bore; and an insert received within the bore, wherein said insert comprises a stem portion and a part-spherical head portion with a transition region therebetween, wherein said stem portion is completely contained within the bore, wherein the part-spherical head portion extends axially beyond an end of the valve member and spans an internal diameter of the bore so as to maintain contact with an internal surface of the bore as the valve member moves, in use, so as to guide movement of the valve member, and wherein the part-spherical head portion has a larger diameter than the stem portion, the transition region including a shoulder surface that defines an internal seating for the valve member adapted to selectively permit or obstruct flow of a fluid therebetween;

wherein the insert is an inner valve that is slidable within the bore and engageable with an insert seating defined by the seating surface so as to control fuel injection through at least one second nozzle outlet, wherein the valve member includes an annular member that is received within the bore so as to be engageable with the internal seating;

the injection nozzle further comprising a sleeve member coupled to the inner valve, wherein the annular member is brought into engagement with the sleeve member when the valve member is moved axially through a distance that is greater than a predetermined distance so as to impart axial movement to the inner valve also.

2. An injection nozzle according to claim 1, wherein the annular member and the sleeve member have opposed end faces that are spaced apart by the predetermined distance when the valve member is seated against the external seating and the inner valve is seated against the insert seating.

3. An injection nozzle according to claim 1, wherein the end face of the annular member is frusto-conical.

4. An injector for use in an internal combustion engine, wherein the injector includes an injection nozzle comprising:

a nozzle body disposed about a longitudinal axis, said nozzle body defining a seating surface and having at least one first nozzle outlet;

a valve member received within the nozzle body and being engageable with an external seating defined by the seating surface so as to control fuel injection through the at least one first nozzle outlet, the valve member being provided with a blind axial bore and defining a passage extending radially from the outer surface of the valve member to the bore; and an insert received within the bore, wherein said insert comprises a stem portion and a part-spherical head portion with a transition region therebetween, wherein said stem portion is completely contained within the bore, wherein the part-spherical head portion extends axially beyond an end of the valve member and spans an internal diameter of the bore so as to maintain contact with an internal surface of the bore as the valve member moves, in use, so as to guide movement of the valve member, and wherein the part-spherical head portion has a larger diameter than the stem portion, the transition region including a shoulder surface that defines an internal seating for the valve member adapted to selectively permit or obstruct flow of a fluid therebetween; and an actuator for controlling movement of the valve member, wherein the actuator is a piezoelectric actuator.

5. An injection nozzle for an internal combustion engine, the injection nozzle comprising:

a nozzle body disposed about a longitudinal axis, said nozzle body defining a seating surface and having at least one first nozzle outlet;

a valve member received within the nozzle body and being engageable with an external seating defined by the seating surface so as to control fuel injection through the at least one first nozzle outlet, the valve member being provided with a blind axial bore and defining a passage extending radially from the outer surface of the valve member to the bore; and an insert received within the bore and spanning an internal diameter of the bore so as to maintain contact with an internal surface of the bore as the valve member moves, in use, so as to guide movement of the valve member, wherein the insert includes a surface that defines an internal seating for the valve member, wherein the valve member includes an annular member that is received within the bore so as to be engageable with the internal seating to selectively permit or obstruct flow of a fluid therebetween, and wherein the external seating and the internal seating are positioned along the axis of the nozzle body at approximately the same axial position at least when the valve member is seated.

* * * * *